US006538551B2

(12) United States Patent
Henricks

(10) Patent No.: US 6,538,551 B2
(45) Date of Patent: Mar. 25, 2003

(54) HEAT CONCENTRATING BARREL FOR WIRE HEATER IN DUAL ELEMENT FUSES

(75) Inventor: Michael C. Henricks, Ballwin, MO (US)

(73) Assignee: Cooper Technologies Company, Houston, TX (US)

( * ) Notice: Subject to any disclaimer, the term of this patent is extended or adjusted under 35 U.S.C. 154(b) by 3 days.

(21) Appl. No.: 09/935,039

(22) Filed: Aug. 22, 2001

(65) Prior Publication Data

US 2003/0038702 A1 Feb. 27, 2003

(51) Int. Cl.[7] ..... H01H 85/08; H01H 85/055

(52) U.S. Cl. ..... 337/292; 337/161; 337/162; 337/164; 337/182; 337/184; 337/295

(58) Field of Search ..... 337/159, 161–164, 337/182–184, 290–295, 416, 417; 29/623

(56) References Cited

U.S. PATENT DOCUMENTS

| | | | | | |
|---|---|---|---|---|---|
| 2,321,711 | A | * | 6/1943 | Taylor | 337/165 |
| 2,613,297 | A | * | 10/1952 | Laing | 337/164 |
| 2,688,677 | A | * | 9/1954 | Laing | 337/164 |
| 2,787,684 | A | * | 4/1957 | Laing | 337/164 |
| 2,913,555 | A | * | 11/1959 | Mc Alister | 337/164 |
| 3,342,964 | A | * | 9/1967 | Kozacka | 337/164 |
| 4,593,262 | A | * | 6/1986 | Krueger | 337/163 |
| 4,888,573 | A | * | 12/1989 | Dunn | 337/164 |
| 4,992,770 | A | * | 2/1991 | Spalding et al. | 337/164 |
| 5,043,689 | A | * | 8/1991 | Di Troia et al. | 337/165 |
| 5,075,664 | A | * | 12/1991 | Spalding et al. | 337/164 |
| 5,235,306 | A | * | 8/1993 | Kalra et al. | 337/165 |
| 5,239,291 | A | * | 8/1993 | Henricks et al. | 337/164 |
| 5,247,274 | A | * | 9/1993 | Gurevich | 337/164 |
| 5,254,967 | A | * | 10/1993 | Biasutti et al. | 337/165 |
| 5,298,877 | A | * | 3/1994 | Gurevich et al. | 337/164 |
| 5,406,244 | A | * | 4/1995 | Thwaites et al. | 337/163 |

FOREIGN PATENT DOCUMENTS

| | | | | | |
|---|---|---|---|---|---|
| JP | 03105825 | A | * | 5/1991 | H01H/85/00 |

* cited by examiner

*Primary Examiner*—Anatoly Vortman
(74) *Attorney, Agent, or Firm*—Armstrong Teasdale LLP

(57) ABSTRACT

A dual element fuse includes a first conductive fuse coupler portion and an overload fusing assembly coupled to the first conductive fuse coupler portion. The overload fusing assembly includes a barrel having a flange at one end thereof, a trigger received within said barrel and positioned in a pre-operated position by a fusing alloy, and a conductive coil surrounding the barrel predominately in an area adjacent the flange. The conductive coil is connected between the first conductive fuse coupler portion and the flange, thereby concentrating heat generated in the conductive coil toward the flange.

20 Claims, 5 Drawing Sheets

HEAT CONCENTRATING BARREL FOR WIRE HEATER IN DUAL ELEMENT FUSES

BACKGROUND OF THE INVENTION

This invention relates generally to fuses, and, more particularly, to dual element fuses.

Fuses are widely used as overcurrent protection devices to prevent costly damage to electrical circuits. Typically, fuse terminals form an electrical connection between an electrical power source and an electrical component or a combination of components arranged in an electrical circuit. One or more fusible links or elements, or a fuse element assembly, is connected between the fuse terminals, so that when electrical current through the fuse exceeds a predetermined threshold, the fusible elements melt, disintegrate, sever, or otherwise open the circuit associated with the fuse to prevent electrical component damage.

One type of a dual element, time delay fuse includes a short circuit fuse element and an overload fuse element. The short circuit element typically is a conductive strip having a number of areas of reduced cross section, or weak spots. The weak spots are dimensioned to melt or otherwise open a circuit through the dual element fuse upon sustained predetermined overload current conditions, such as, for example, 700% of the current rating of the fuse. The overload fuse element, installed in series with the short circuit element, typically includes a spring-loaded trigger with a heating element. A fusing alloy, connects the heater elements to parts of the trigger and also connects the trigger to the short circuit fuse element. Upon sustained overload conditions, such as, for example, currents of 120% to 600% of the current rating of the fuse, the fusing alloy melts, thereby releasing a compression spring that separates the trigger from the short circuit fuse element and opens the electrical circuit through the fuse. In one such type of fuse, the trigger assembly includes a barrel surrounding the trigger and a resistive copper alloy heating strip supplying heat to the barrel for melting the fusing alloy of the trigger. Sec, for example, U.S. Pat. No. 5,239,291.

While the above-described dual element fuse construction is well suited for fuses having higher current ratings, for fuses of smaller current ratings, e.g., up to 10 amps, the heater strip becomes too thin and fragile for typical manufacturing operations. Resistive wires are sometimes used in lieu of the heater strips to supply heat to operate an overload fuse element trigger assembly upon the occurrence of sustained overload conditions. However, use of resistive wire to heat the trigger assembly conventionally requires a different, and more complicated construction of the trigger assembly in comparison to that described above. See for example, U.S. Pat. No. 4,888,573 employing a tension spring assembly for the trigger. Aside from the associated manufacturing difficulties of these trigger assemblies, resistance wire heating of the trigger in a dual element fuse does not always operate the trigger as effectively as desired. Still further, the trigger tends to undesirably increase watt losses for the circuit associated with the fuse, thereby reducing energy efficiency.

BRIEF DESCRIPTION OF THE INVENTION

In one aspect, a dual element fuse is provided that includes a first conductive fuse coupler portion and an overload fusing assembly coupled to the first conductive fuse coupler portion. The overload fusing assembly includes a barrel having a flange at one end thereof, a trigger received within said barrel and positioned in a pre-operated position by a fusing alloy, and a conductive coil surrounding the barrel predominately in an area adjacent the flange. The conductive coil is connected between the first conductive fuse coupler portion and the flange, thereby concentrating heat generated in the conductive coil toward the flange. As such, the overload fusing assembly operates more efficiently with a simpler construction than known, lower amperage, overload fusing assemblies utilizing conductive wire to heat a trigger assembly.

In another aspect, a dual element fuse is provided that includes a first conductive fuse coupler portion, an overload fusing assembly coupled to the first fuse coupler portion, the overload fuse assembly comprising a barrel having a flange, a spring-loaded trigger mounted within the barrel in a pre-operated position, and at least one conductive coil surrounding the barrel and providing a conductive path between the first conductive coupler portion and the barrel flange. A short circuit fuse assembly is coupled to the trigger with a fusing alloy, and a second fuse coupler portion is coupled to the short circuit fuse assembly to complete a circuit through the fuse.

In still another aspect, an overload fusing assembly for a dual element fuse is provided. The overload fusing assembly includes a barrel comprising a longitudinal opening therethrough and a flange on an end thereof. The barrel flange includes at least one mounting aperture therein, and a trigger is received in the longitudinal opening and includes a flange located within the opening and a body extending from the opening in a pre-operated position. A spring is disposed between the barrel flange and the trigger flange, and the spring is in compression in said pre-operated position. A conductive wire is attached to the barrel flange and is wrapped around the barrel adjacent the barrel flange, thereby concentrating heat generated within said wire to the barrel near the flange.

In yet another aspect, an overload fusing assembly for a dual element fuse is provided. The overload fusing assembly includes a barrel comprising a longitudinal opening therethrough and a flange on an end thereof The flange includes at least one mounting aperture therein, and a rib extends on an external perimeter the barrel. A trigger is received in the barrel longitudinal opening and partially extends therefrom in a pre-operated position. A spring is disposed between the barrel flange and the trigger, and the spring is placed in compression in the pre-operated position. A conductive wire is attached to the barrel flange and is wrapped around the barrel between the barrel flange and the rib, thereby concentrating heat generated within the barrel to the barrel near the flange.

DETAILED DESCRIPTION OF THE INVENTION

Figure 1:
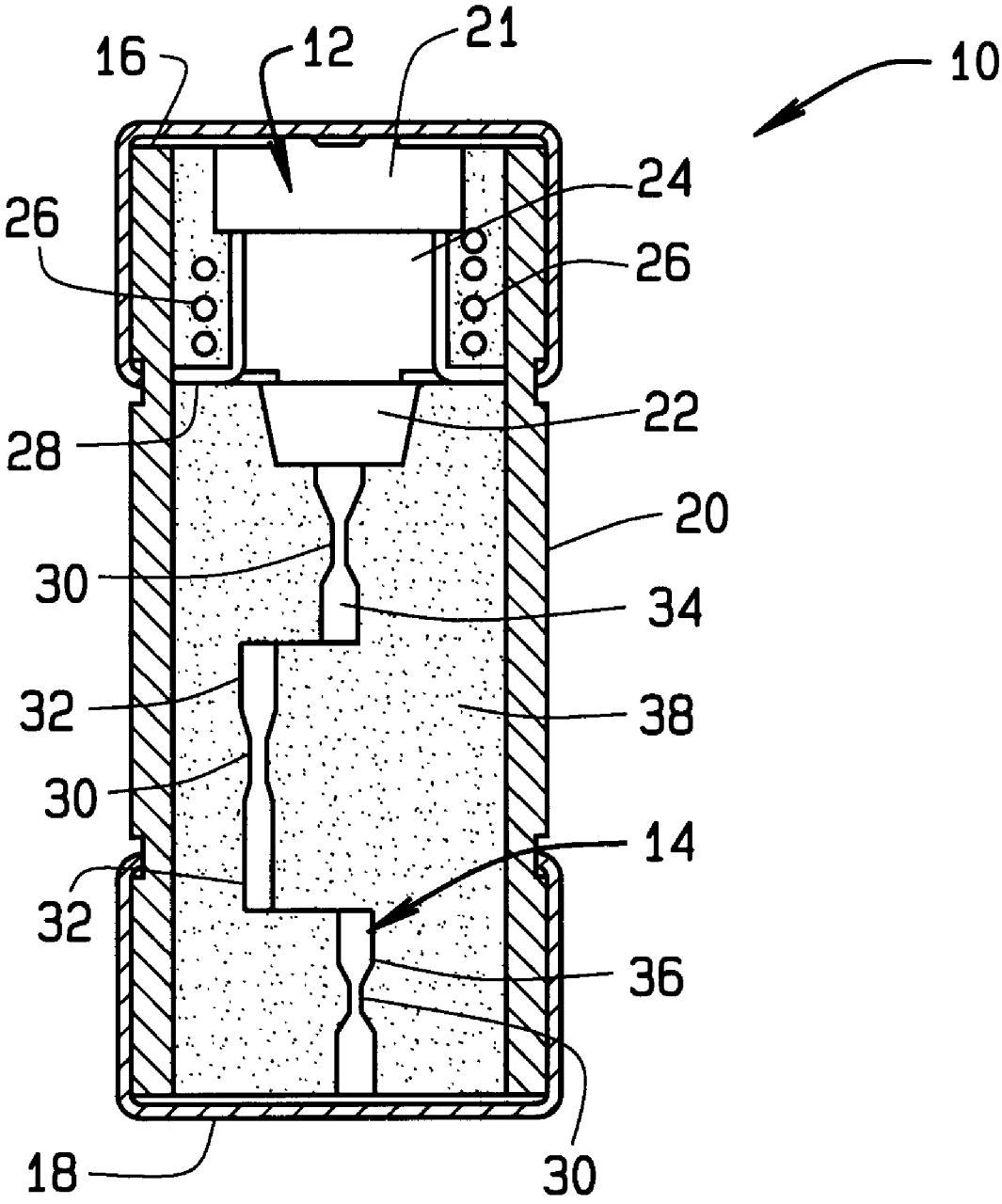
FIG. 1 cross sectional schematic view of a dual-element fuse including an overload fusing assembly.

FIG. 1 is a cross sectional schematic view of a dual-element fuse 10 including an overload fusing assembly 12 and a series connected short circuit fuse element 14. While overload fusing assembly 12 and short circuit fuse element 14 are illustrated in the context of cylindrical ferrule fuse 10, it is appreciated that the benefits of the invention apply equally to other fuse constructions, such as those with blade-type terminal connectors and cube fuses having plug-in terminal blade connectors. Fuse 10 is therefore set forth for illustrative purposes only, and the invention is in no way intended to be limited in application to a particular type of fuse, such as fuse 10.

Overload fusing assembly 12 and short circuit fuse element 14 are connected in series between opposite conductive coupling portions 16, 18 extending from, or coupled to an insulating fuse body 20. In the illustrated embodiment, fuse coupling portions 16, 18 are conductive end caps attached to opposite ends of a substantially cylindrical fuse body 20, and each end cap is adapted for line-side and load-side electrical connection to an external circuit (not shown). In alternative, embodiments, and as noted above, fuse coupling portions 16, 18 may be blade terminal connectors familiar to those in the art, or plug-in connectors attached to, or extending from, a cylindrical, or non-cylindrical fuse body or housing fabricated from an insulative, i.e., nonconductive material. In a particular alternative embodiment (not shown), fuse coupling portions 16, 18 are plug-in blade terminal connectors extending from a rectangular-shaped fuse housing, such as those found in the CUBEFuse™ line of fuses commercially available from Bussmann of St. Louis, Mo., a division of Cooper Technologies of Houston, Tex.

Overload fusing assembly 12 and short circuit element 14 are sized and dimensioned to provide a desired current, or amperage, rating of fuse 10. When fuse coupler portions 16, 18 are coupled to line-side and load-side electrical equipment, components, and circuits, respectively, a current path is established through fuse 10, and more specifically, through overload fusing assembly 12 and short circuit fuse element 14. Upon the occurrence of sustained current overload conditions, greater than the fuse amperage rating (e.g., 120% to 600% of rated current in an exemplary embodiment) and dependant upon time delay characteristics of fuse 10, overload fusing assembly 14 opens the current path through fuse 10, as further explained below. Upon the occurrence of a short circuit condition, generating nearly instantaneous current surges, (e.g., 700% or more of rated current in an exemplary embodiment) short circuit fuse element 14 opens the current path through fuse 10, thereby protecting and isolating load-side circuits, components and equipment from damaging from damaging fault currents.

In an illustrative embodiment, overload fusing assembly 14 includes an insulator 21, a barrel 24 received in insulator 21, a spring-loaded trigger 22 received in barrel 24, and a coil 26 of resistance wire surrounding barrel 24 and supplying heat thereto for operation of trigger 22, explained further below. Barrel 24 includes a flange 28 on one end thereof, and resistance wire coil 26 is coupled to and extends between fuse coupler portion 16 and barrel flange 28. A conductive path is therefore established between fuse coupler portion 16 and barrel flange 28, and a portion of trigger 22 establishes an electrical path between barrel flange 28 and short circuit fuse element 14 that is coupled to fuse coupler portion 18. When, for example, fuse coupler portions 16, 18 are coupled to line-side and load-side electrical circuitry, respectively, current flows through fuse 10 from coupler portion 16, through resistance wire coil 26 to barrel flange 28, and from barrel flange 28 through trigger 22 to short circuit fuse element 14, and ultimately to fuse coupler portion 18. As current flows through resistance wire coil 26, heat is generated and applied to barrel 24 to operate trigger 22, as explained in detail below.

Short circuit fuse element 14, in an exemplary embodiment, includes a number of constrictions 30 of reduced cross sectional area, sometimes referred to as weak spots. The weak spots are dimensioned and located so that, as current flows therethrough, heat generated in short circuit element 14 is greater at the weak spots than a remainder of short circuit fuse element 14. As such, when current through short circuit fuse element 14 reaches sufficient levels, short circuit fuse element 14 melts at the weak spots before remaining sections of fuse element 14. In alternative embodiments, short circuit fuse element 14 may include openings therethrough in lieu of constrictions 20 to form the weak spots. In a further alternative embodiment, more than one short circuit fuse element could be employed in fuse 10.

Additionally, in one embodiment, short circuit fuse element 14 includes an offset portion 32, i.e., an off-centered portion, that is laterally offset from a first portion 34 extending from trigger 22 and a second portion 36 extending between fuse element offset portion 32 and fuse coupler portion 18. In alternative embodiments, differently configured short circuit fuse elements may be employed having greater or fewer portions or segments.

An arc-quenching media 38, such as, for example, silica sand surrounds overload fusing assembly 12 and short circuit fuse element 14 to suppress are energy when overload fusing assembly or short circuit fuse element 14 opens or operates to sever an electrical connection through fuse 10.

Figure 2:
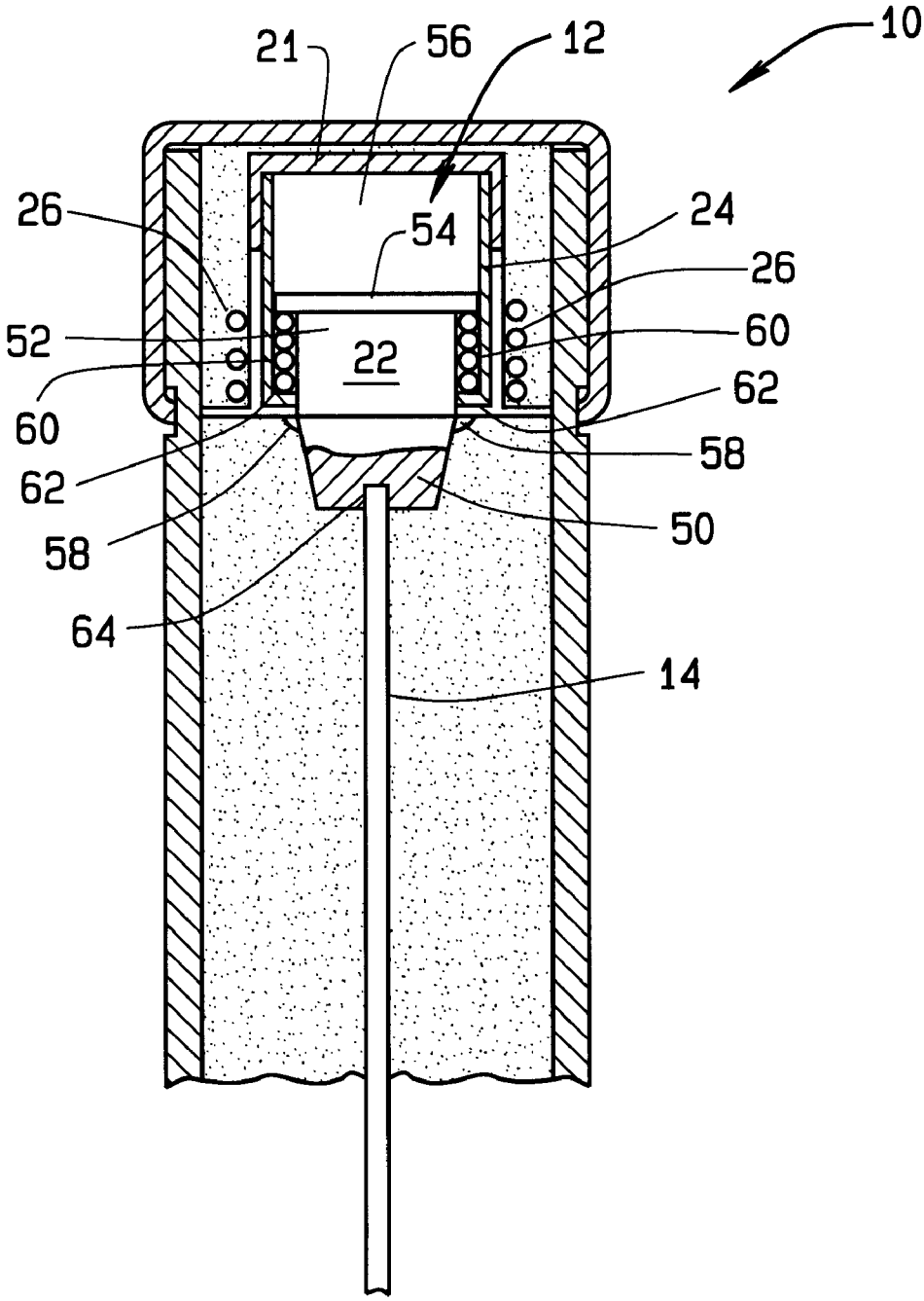
FIG. 2 is a cross sectional schematic view of the dual element fuse shown in FIG. 1 rotated 90° and illustrating the overload fusing assembly in a pre-operated position.

FIG. 2 is a cross sectional schematic view of dual element fuse 10 shown in FIG. 1 rotated 90° and illustrating overload fusing assembly 12 in a pre-operated position.

Trigger 22 includes a tapered head portion 50, a cylindrical body portion 52, and a flange 54 received in hollow barrel 24 and positioned at a distance from insulator 21, thereby creating an air gap 56 within barrel 24 between insulator 21 and trigger flange 54. Trigger flange 54 is held in place by a fusing alloy 58, such as a solder alloy familiar to those in the art, and the resultant position of trigger 22 relative to barrel 24 compresses a coil spring 60 disposed between the outer wall of trigger body 52 and an inner wall of barrel 24. Trigger body 52 extends through an opening in barrel 24, and coil spring 60 is compressed between trigger flange 54 and an end surface 62 of barrel 24. Resistive wire coil 26 is wrapped around an outer surface of barrel 24. Unlike known dual element fuses employing resistive wire to heat an overload fusing assembly, and as further described below, wire coil 26 of overload fusing assembly 12 is positioned with respect to barrel 24 such that heat generated in wire coil 26 is concentrated to specific locations of barrel 24 to ensure efficient operation of trigger 22.

Trigger tapered head 50 extends from trigger body 52 through the opening in barrel 24, and short circuit fuse element 14 is coupled to trigger head 50 with a fusing solder alloy 64 or other suitable compositions known in the art.

Figure 3:
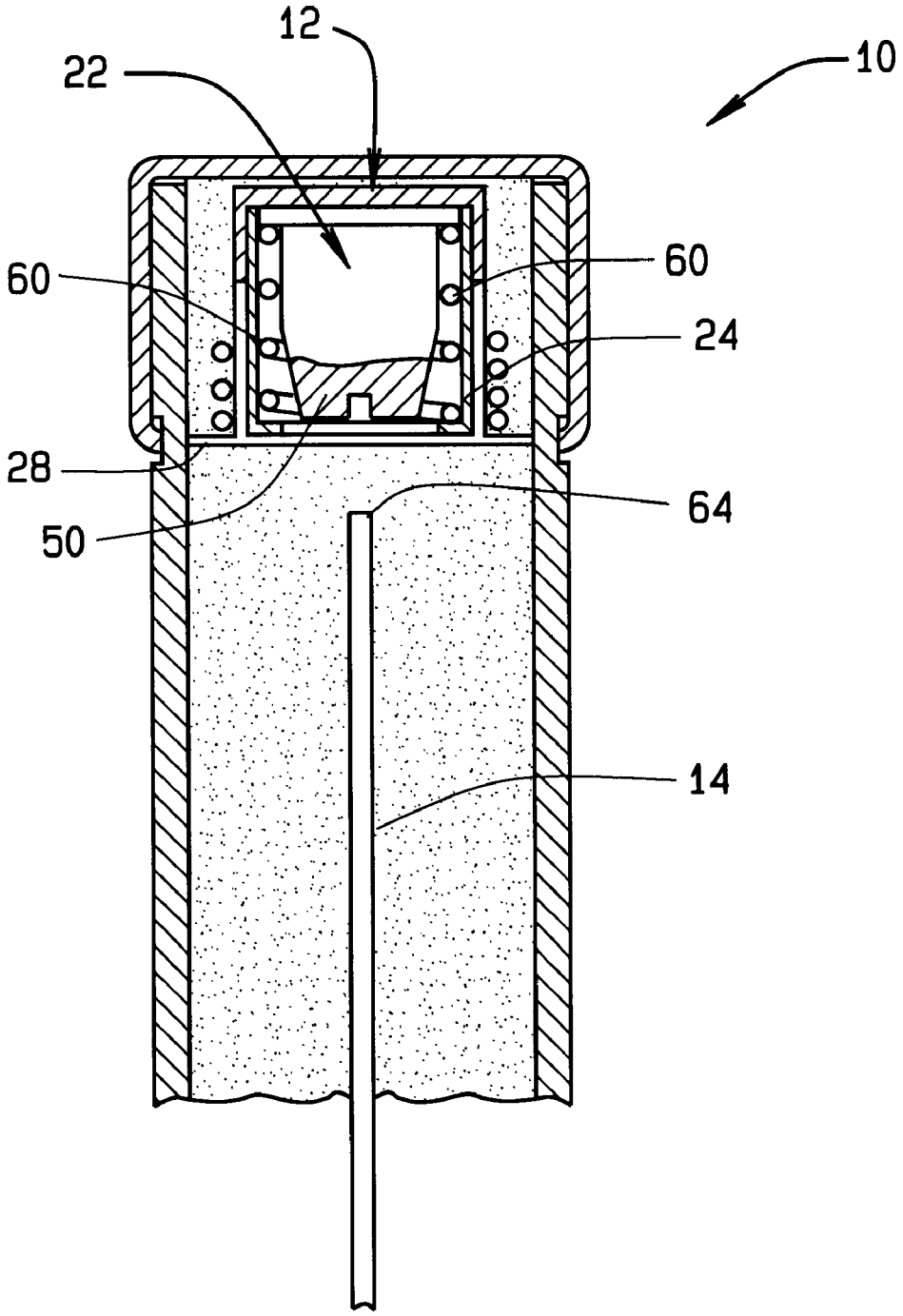
FIG. 3 is a cross sectional schematic view similar to FIG. 2 but illustrating the overload fusing element in an operated state.

FIG. 3 is a cross sectional schematic view of fuse 10 illustrating overload fusing element 12 in an operated state after heat generated by sustained overload currents melt or sufficiently weaken fusing alloy 58 that holds trigger 22 in the pre-operated position (shown in FIG. 1). When fusing alloy 58 is sufficiently weakened, a bias force exerted by compressed spring 60 overcomes the bond of fusing alloy 58 and forces trigger flange 54 within barrel 24 into air gap 56 (shown in FIG. 2) and away from short circuit fuse element 14, thereby pulling trigger head 50 away from short circuit fuse element 14 through fusing alloy 64. As such, electrical connection is broken though fuse 10, and spring 60 biases trigger 22 in the operated position separated from short circuit fuse element 14 to prevent electrical connection through fuse 10 from being re-established.

As such, fuse 10 can withstand overload currents, such as relatively harmless inrush currents common to electric motor operation, for limited times before opening or operating. Time delay characteristics of overload fusing assembly 12 before operating may be varied to satisfy desired parameters as those in the art will appreciate.

Figure 4:
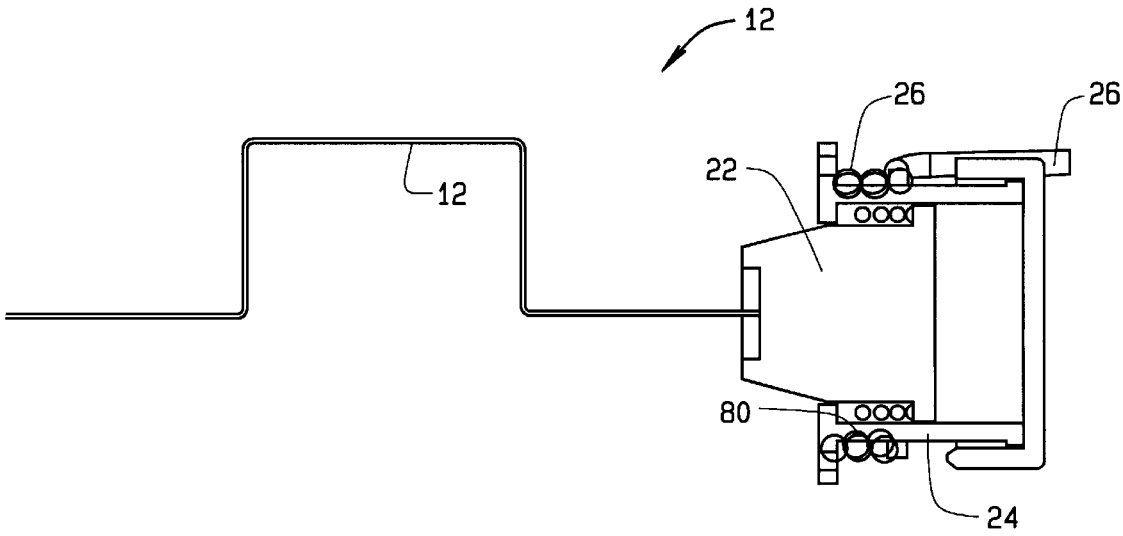
FIG. 4 a is a functional schematic of the fuse assembly shown in FIGS. 1–3 .

FIG. 4 is a functional schematic of overload fusing assembly 12 illustrating resistive wire coil 26 positioned substantially adjacent an upper end 80 of barrel 24 adjacent barrel flange 28. Therefore, heat generated in wire coil 26 is supplied more directly to a location of fusing alloy 58 (shown in FIG. 2) that holds trigger 22 in place in the pre-operated position. Unlike known overload fusing assemblies including resistive wire heating, wire coil 26 ensures efficient operation of trigger 22 by concentrating heat near the operative point of trigger 22, i.e., near the trigger-barrel interface where fusing alloy 58 is located. Concentrating heat of resistance wire 26 over a smaller area of barrel 24 near barrel flange 28 increases watt density at the trigger-barrel interface, thereby lowering overall resistance of fuse 10. As such, adequate heat for efficiently operating trigger 22 can be achieved with a wire coil of lesser resistance in comparison to known overload fusing assemblies employing resistance wire while achieving approximately equal time delay characteristics. Lower resistance wire, in turn, results in a reduced watt loss of the fuse, thereby increasing energy efficiency of the associated fuse, such as fuse 10 (shown in FIGS. 1–3).

Alternatively, increased watt density due to concentrated heat generated by wire coil 26 at the trigger-barrel interface allows a larger diameter wire to be used for coil 26, thereby more effectively generating heat to operate trigger 22 with about the same resistance as known overload fusing assemblies.

In addition, more than one resistive wire coil 26 could be employed to further vary performance aspects and time delay characteristics of overload fusing assembly 14.

Especially when used in lower current environments, e.g., 0–10 amps in one embodiment, overload fusing assembly 12 provides performance and cost advantages over known overload fusing assemblies for low current applications. Overload current protection is achieved while avoiding complicated conventional trigger constructions employing resistive wire heating, thereby reducing manufacturing and assembly costs of the fuse. In addition, concentrated heat transfer to the trigger-barrel interface enhances efficiency and reliability of the fused connection. These benefits are achieved by proper positioning of wire coil 26 with respect to barrel 24, such, as for example, in accordance with the following exemplary embodiments for barrel 24.

Figure 5:
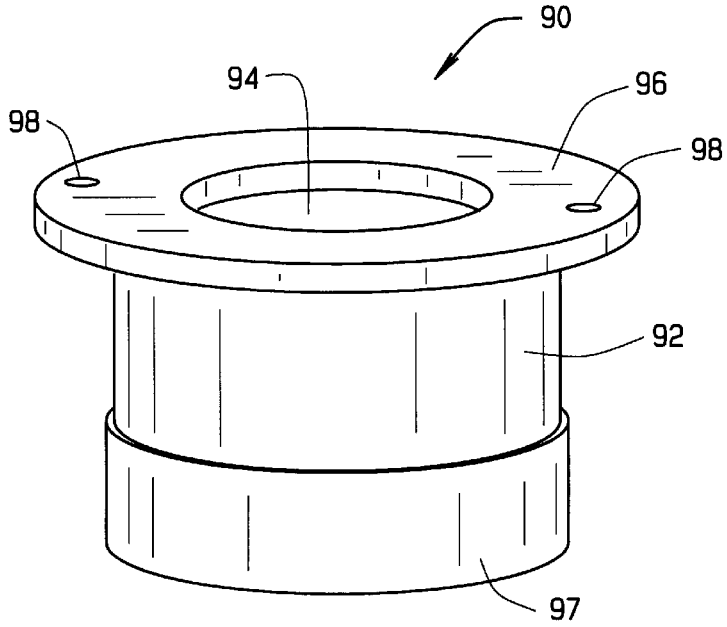
FIG. 5 is perspective view of first embodiment of a heat concentrating barrel for the fuse assembly shown in FIG. 4.

FIG. 5 is perspective view of first embodiment of a heat concentrating barrel 90 for use with overload fusing assembly 12 (shown in FIGS. 1–4). Barrel 90 includes a substantially cylindrical body 92 having a longitudinal opening 94 therethrough for receiving trigger 22 (shown in FIGS. 1–4). A flange 96 extends outwardly from barrel body 92 at one end, and an insulator 97 is attached to and receives an opposite end of barrel body 92. Barrel flange includes apertures 98 therethrough to facilitate attachment of an end of a resistive wire coil, such as coil 26 (shown in FIGS. 1–4) according to known methods or techniques, such as, for example, a soldering or welding process. Although the illustrated barrel 90 includes two openings 98 in barrel flange 96, thus being configured for attachment of two lengths of conductive wire (not shown), flange 96 should not be construed to be so limited, as fewer or greater number of lengths of resistive wire are contemplated to vary time delay characteristics of fuse 10 (shown in FIGS. 1–4).

In use, a conductive coil is wrapped around barrel 90 predominately in an upper area of body 92 adjacent barrel flange 96, rather than evenly distributed over body 92. As such a concentrated heat effect is realized, and the aforementioned benefits realized.

Figure 6:
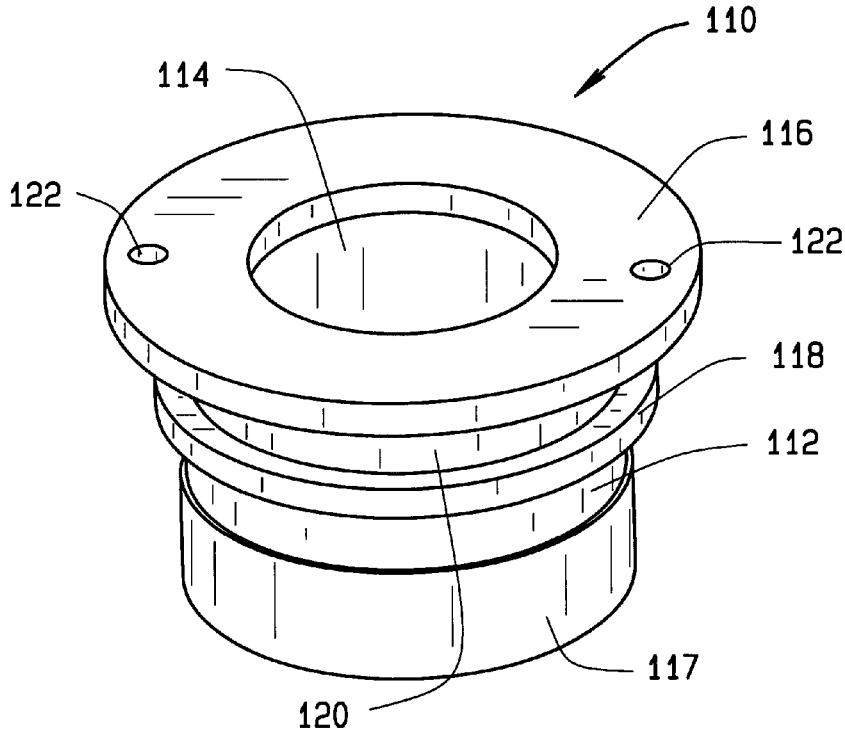
FIG. 6 respective view of second embodiment of a heat concentrating barrel for the fuse assembly shown in FIG. 4.

FIG. 6 is perspective view of second embodiment of a heat concentrating barrel 110 for use with overload fusing assembly 12 (shown in FIGS. 1–4). Barrel 110 includes a substantially cylindrical body 112 having a longitudinal opening 114 therethrough for receiving trigger 22 (shown in FIGS. 1–4). A flange 116 extends outwardly from barrel body 112 at one end, and an insulator 117 is attached to and receives an opposite end of barrel body 112. Unlike barrel 90 (shown in FIG. 5) barrel 110 includes a concentric rib 118 extending around a perimeter of barrel body 112 beneath barrel flange 116. In use, one or more lengths of conductive wire coil such as coil 26 (shown in FIGS. 1–6) are wrapped around an area 120 of body 112 located between rib 118 and flange 116.

Wrapping the conductive wire around area 120 defined by rib 118 and barrel flange 116 causes the heat generated by conductive wire to be concentrated toward flange 116 and the barrel-trigger interface of fuse 10, thereby achieving the benefits noted above.

Barrel flange 116 includes apertures 122 therethrough to facilitate attachment of an end of a resistive wire coil, such as coil 26 (shown in FIGS. 1–4) according to known methods or techniques, such as, for example, a soldering or welding process. Although the illustrated barrel 110 includes two openings 122 in barrel flange 116, thus being configured for attachment of two lengths of conductive wire (not shown), flange 116 should not be construed to be so limited, as fewer or greater number of lengths of resistive wire are contemplated to vary time delay characteristics of fuse 10 (shown in FIGS. 1–4).

Figure 7:
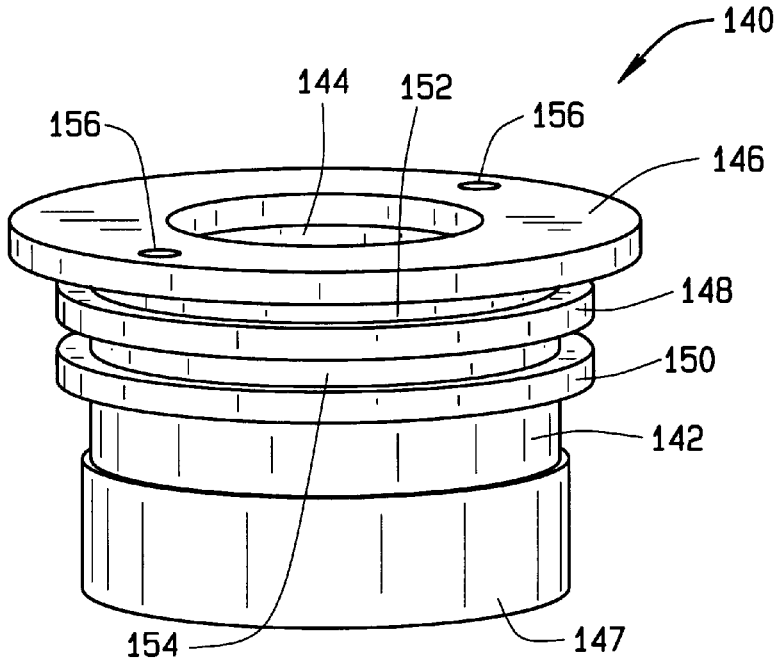
FIG. 7 is perspective view of third embodiment of a heat concentrating barrel for the fuse assembly shown in FIG. 4.

FIG. 7 is perspective view of third embodiment of a heat concentrating barrel 140 for use with overload fusing assembly 12 (shown in FIGS. 1–4). Barrel 140 includes a substantially cylindrical body 142 having a longitudinal opening 144 therethrough for receiving trigger 22 (shown in FIGS. 1–4). A flange 146 extends outwardly from barrel body 142 at one end, and an insulator 147 is attached to and receives an opposite end of barrel body 112. Unlike barrel 110 (shown in FIG. 6) barrel 140 includes first and second concentric ribs 148, 150 extending around a perimeter of barrel body 142 beneath barrel flange 146. In use, the one or more lengths of conductive wire coil, such as coil 26 (shown in FIGS. 1–6) are wrapped around an area 152 or 154 of body 142 located between respective ribs 148, 150 and barrel flange 116.

Wrapping the conductive wire around areas 152, 154, defined by ribs 148, 150 and flange 146 causes heat generated the by conductive wire to be concentrated toward flange 146 and the barrel-trigger interface of fuse 10, thereby achieving the benefits noted above.

Barrel flange 146 includes apertures 156 therethrough to facilitate attachment of an end of a resistive wire coil, such as coil 26 (shown in FIGS. 1–4) according to known methods or techniques, such as a soldering or welding process. Although the illustrated barrel 140 includes two openings 156 in barrel flange 146, thus being configured for attachment of two lengths of conductive wire (not shown), flange 146 should not be construed to be so limited, as fewer or greater number of lengths of resistive wire are contemplated to vary time delay characteristics of fuse 10 (shown in FIGS. 1–4).

While the invention has been described in terms of various specific embodiments, those skilled in the art will recognize that the invention can be practiced with modification within the spirit and scope of the claims.

What is claimed is:

1. A dual element fuse comprising:

a first conductive fuse coupler portion; and an overload fusing assembly coupled to said first conductive fuse coupler portion, said overload fusing assembly comprising a barrel comprising a flange at one end thereof;

a trigger received within said barrel and positioned in a pre-operated position by a fusing alloy; and a conductive coil surrounding said barrel predominately in an area adjacent said flange and connected between said first conductive fuse coupler portion and said flange, thereby concentrating heat generated in the conductive coil toward said flange.

2. A dual element fuse in accordance with claim 1 further comprising an insulator positioned between said barrel and said first conductive fuse coupler portion.

3. A dual element fuse in accordance with claim 1 wherein said trigger is positioned in said barrel in a pre-operated state to create an air gap in said barrel.

4. A dual element fuse in accordance with claim 3 wherein said trigger comprises a flange, said overload fusing assembly further comprising a spring disposed between said trigger flange and said barrel flange.

5. A dual element fuse in accordance with claim 4 wherein said spring is compressed in said pre-operated position.

6. A dual element fuse in accordance with claim 1 wherein said fuse coupler portion comprises an end cap.

7. A dual element fuse in accordance with claim 1 wherein said barrel comprises a rib extending from a perimeter thereof, thereby positioning said conductive coil adjacent said flange.

8. A dual element fuse in accordance with claim 7 wherein said barrel comprises a plurality of ribs.

9. A dual element fuse comprising:

a first conductive fuse coupler portion, an overload fusing assembly coupled to said first fuse coupler portion, said overload fuse assembly comprising a barrel having a flange, a spring-loaded trigger mounted within said barrel in a pre-operated position, and at least one conductive coil surrounding said barrel and providing a conductive path between said first conductive coupler portion and said barrel flange;

a short circuit fuse assembly coupled to said trigger with a fusing alloy; and a second fuse coupler portion coupled to said short circuit fuse assembly.

10. A dual element fuse in accordance with claim 8 wherein said spring-loaded trigger comprises a compression spring.

11. A dual element fuse in accordance with claim 1 wherein said overload fusing assembly comprises a fusing alloy bonding said trigger to said barrel flange in said pre-operated position.

12. A dual element fuse in accordance with claim 11 wherein said at least one conductive coil is located predominately adjacent said flange, thereby concentrating heat generated therein toward said fusing alloy bonding said trigger to said barrel.

13. A dual element fuse in accordance with claim 12 wherein said barrel comprises a rib extending from a perimeter thereof beneath said barrel flange, said rib positioning said at least one coil adjacent said flange.

14. A dual element fuse in accordance with claim 13 wherein said barrel comprises a plurality of ribs for positioning said at least one coil.

15. A dual element fuse in accordance with claim 9 wherein said first and second fuse coupler portions comprise end caps.

16. An overload fusing assembly for a dual element fuse, said overload fusing assembly comprising:

a barrel comprising a longitudinal opening therethrough and a flange on an end thereof, said flange comprising at least one mounting aperture therein;

a trigger received in said longitudinal opening and comprising a flange located within said opening and a body extending from said opening in a pre-operated position;

a spring disposed between said barrel flange and said trigger flange, said spring in compression in said pre-operated position; and a conductive wire attached to said barrel flange and wrapped around said barrel adjacent said barrel flange, thereby concentrating heat generated within said wire to said barrel near said flange.

17. An overload fusing assembly in accordance with claim 16 further comprising an insulator coupled to said barrel, said insulator and said trigger flange separated by an air gap.

18. An overload fusing assembly in accordance with claim 17 wherein said spring moves said trigger flange through said air gap when said overload fuse assembly is operated.

19. An overload fusing assembly in accordance with claim 16 wherein said barrel comprises a rib on a perimeter thereof, said rib positioning said wire.

20. An overload fusing assembly for a dual element fuse, said overload fusing assembly comprising:

a barrel comprising a longitudinal opening therethrough, a flange on an end thereof, said flange comprising at least one mounting aperture therein, and a rib on an external perimeter thereof;

a trigger received in said longitudinal opening and partially extending therefrom in a pre-operated position;

a spring disposed between said barrel flange and said trigger, said spring in compression in said pre-operated position; and a conductive wire attached to said barrel flange and wrapped around said barrel between said barrel flange and said rib, thereby concentrating heat generated within said wire to said barrel near said flange.

* * * * *